United States Patent [19]

Johnston

[11] Patent Number: 4,731,902

[45] Date of Patent: Mar. 22, 1988

[54] DOOR AND GATE SPRING

[75] Inventor: James R. Johnston, Sterling, Ill.

[73] Assignee: National Manufacturing Co., Sterling, Ill.

[21] Appl. No.: 406,509

[22] Filed: Aug. 9, 1982

[51] Int. Cl.[4] ..... E05F 1/12

[52] U.S. Cl. ..... 16/72; 16/76; 16/286; 16/300; 16/DIG. 10; 267/179

[58] Field of Search ..... 16/75, 76, 72, 286, 16/298, 299, 300, 304, 308, DIG. 10, DIG. 36; 267/179

[56] References Cited

U.S. PATENT DOCUMENTS

| | | | |
|---|---|---|---|
| 135,192 | 1/1873 | Espey | 16/76 |
| 136,482 | 3/1873 | Bean et al. | 16/76 |
| 137,770 | 4/1873 | Foster . | |
| 224,377 | 2/1880 | Barker | 16/76 |
| 242,429 | 6/1881 | Butler | 16/76 |
| 243,088 | 6/1881 | Taylor et al. | 16/76 |
| 244,184 | 7/1881 | Clark | 16/76 |
| 406,025 | 7/1889 | Calahan | 16/76 |
| 532,787 | 1/1895 | Keene | 16/76 |
| 646,223 | 3/1900 | Keil et al. . | |
| 698,744 | 4/1902 | Schwartz . | |
| 1,249,111 | 12/1917 | Katzenberger | 16/76 |
| 1,302,477 | 4/1919 | Smith | 267/179 |
| 1,695,454 | 12/1928 | Coyne | 16/72 X |

FOREIGN PATENT DOCUMENTS

| | | | |
|---|---|---|---|
| 4519 | 11/1877 | United Kingdom | 16/76 |

*Primary Examiner*—Fred Silverberg

*Attorney, Agent, or Firm*—Edmond T. Patnaude

[57] ABSTRACT

A coil spring has elliptical openings in the end turns for non-rotatably receiving elliptically shaped studs which are press-fitted into the spring, the ends being respectively attached to a pair of mounting brackets.

5 Claims, 7 Drawing Figures

DOOR AND GATE SPRING

The present invention relates to adjustable door and gate spring assemblies of the type generally shown and described in U.S. Pat. No. 137,770, and it relates more particularly to an improved method and means for affixing the ends of the springs to the associated parts of the assembly.

BACKGROUND OF THE INVENTION

For more than a century the use of a coil spring non-rotatably attached at one end to a first bracket and non-rotatably attached at its other end to an adjusting member rotatably mounted in a second bracket has been a well known practice in the manufacture of return springs for doors and gates. Many ways have been devised for making the necessary locking connections between the ends of the springs and the associated mounting members. For example, U.S. Pat. No. 137,770 discloses a return spring assembly in which the end members are externally threaded and the end turns of the spring are threaded thereover. U.S. Pat. No. 646,223 discloses the use of a cross slot in the end member for receiving the bent-in end turn of the spring, and U.S. Pat. No. 698,744 discloses a similar spring locking arrangement. Such locking systems are relatively expensive, and they are difficult to repair and maintain. Consequently, the door and gate springs of this general type which are now on the market utilize a cylindrical stud which is press-fitted into the corresponding end of the spring to provide a fixed, non-rotatable connection between the stud and the spring. The studs are in turn attached to the mounting brackets. In many cases, however, the desired non-rotatable connection has not been achieved because if the diameters of the studs are only slightly less than the specified size, rotational slippage will occur when torque is applied to the adjusting studs. Moreover, relatively close dimensional tolerances must be specified to permit assembly of the parts and still assure a non-rotatable connection between the stud and spring.

SUMMARY OF THE INVENTION

Briefly, there is provided in accordance with the present invention a new and improved door and gate spring assembly comprising a pair of mounting brackets for respective attachment to a jamb member and to a gate or door. A first headed stud is non-rotatably connected to one of the mounting brackets, and a second headed stud is rotatably connected to the other of the mounting brackets. The shank portions of both of the studs are elliptical in cross-section and the end turns of the return coil spring are also elliptical in cross-section although slightly smaller in internal dimension than the shanks. Accordingly, when the ends of the spring are pressed onto the studs, the interference fits hold the parts in assembled relationship. but, irrespective of the degree of interference the elliptical shape of the interconnected parts assures that the studs cannot be rotated relative to the spring. As a result, the tightness of the fit between the studs and the spring need only be sufficient to prevent spurious disassembly of the parts without having to be so great as to prevent relative rotation when a substantial torque is applied to the rotatable adjusting stud.

In the preferred embodiment of the invention the two brackets are identical. The head on the non-rotatable stud is larger than the head on the rotatable stud, and one flat thereof abuts the base flange of the associated mounting bracket to prevent rotation between the two parts. After adjustment, the rotatable stud is locked against rotation by inserting a locking pin between the base flange of the associated mounting bracket and the adjacent flat on the head of the rotatable stud.

GENERAL DESCRIPTION OF THE DRAWINGS

The present invention will be better understood by a reading of the following detailed description taken in connection with the accompanying drawing wherein.

DETAILED DESCRIPTION OF A PREFERRED EMBODIMENT OF THE INVENTION

Figure 1:
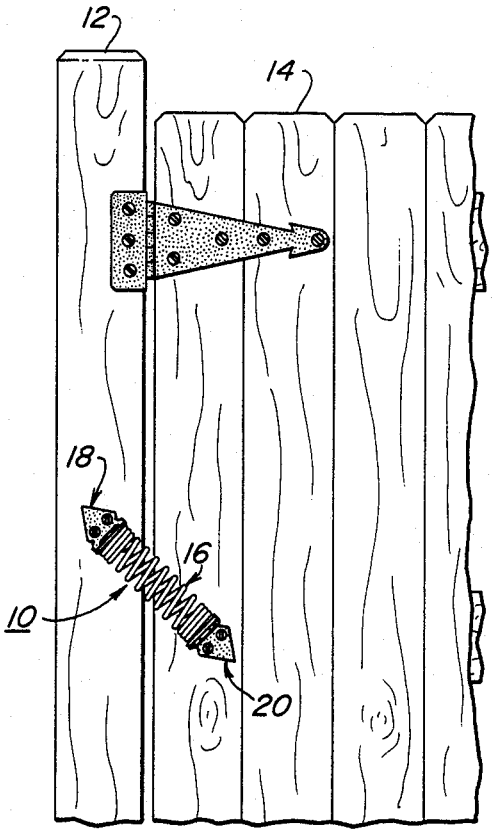
FIG. 1 is a fragmentary, elevational view of a gate with which a return spring assembly of the present invention is employed.

Referring to FIG. 1, there is shown a door and gate return spring assembly 10 connected between a jamb post 12 and a gate or door 14 hingedly connected to the jamb post. The return spring assembly includes a tension coil spring 16 secured at its respective ends to a pair of identical mounting brackets 18 and 20. The bracket 18 is attached to the jamb post 12 by a plurality of screws and the bracket 20 is attached in like manner to the gate 14. As more fully described in connection with FIGS. 2–7, the closing force of the spring is adjustable by rotating an adjusting member at the upper end of the spring 16 to twist the spring about its longitudinal axis.

Figure 2:
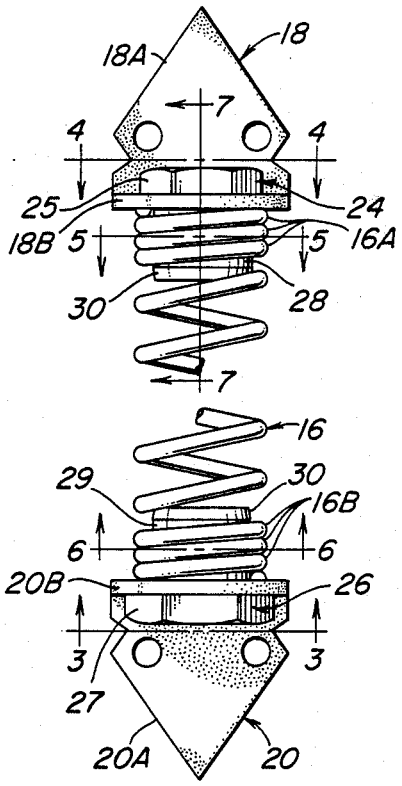
FIG. 2 is a fragmentary plan view of a gate and door spring assembly embodying the present invention.
Figure 3:
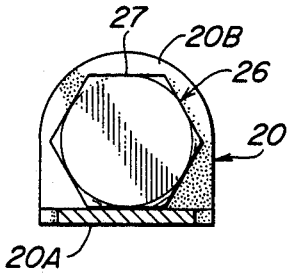
FIG. 3 is a sectional view taken along the line 3—3 of FIG. 2.

As best shown in FIG. 2, the brackets 18 and 20 include respective mounting flanges 18A and 20A and integral spring attaching flanges 18B and 20B which are perpendicular to the mounting flanges 18A and 20A. The flanges 18B and 20B are provided with centrally disposed circular holes 22 (FIG. 7) which respectively receive stud members 24 and 26. The studs 24 and 26 have the same shape and each includes a hexagonal head 25, 27, an intermediate cylindrical shank portion which is rotatably received in the associated hole 22, and an elongated shank portion 28, 29 having a tapered distal end portion 30. The head 27 on the stud 26 is larger than the head 24, and as shown best in FIG. 3 engages the mounting flange 20B to prevent rotation of the stud 26 in the bracket 20. The head 25 is small enough to clear the flange 18A and thus permit rotation of the stud 24 in the bracket 18.

Figure 5:
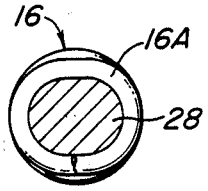
FIG. 5 is a sectional view taken along the line 5—5 of FIG. 2.
Figure 6:
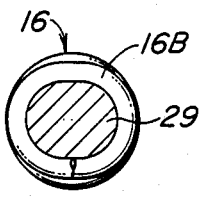
FIG. 6 is a sectional view taken along the line 6—6 of FIG. 2.
Figure 7:
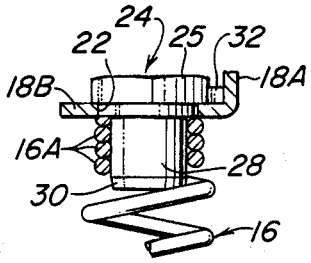
FIG. 7 is a sectional view taken along the line 7—7 of FIG. 2.

In accordance with the present invention the shank portions 28 and 29 of the studs 24 and 26 are non-cylindrical, and the overlying turns 16A, 16B at the ends of the spring 16 are of a complimentary configuration. More particularly, as best shown in FIGS. 5 and 6 the shank portions 28 and 29 are generally elliptical in cross-section and the openings through the ends 16A and 16B of the spring 16 are also generally elliptical but slightly smaller in size so that the ends of the spring 16 fit tightly onto the studs when press-fitted thereon to prevent relative axial movement between the spring and shank portions 28, 29. Spurious disassembly of the spring 16 from the associated studs and brackets is thereby prevented. The elliptical or non-circular complimentary shapes of the shanks and spring ends prevent any relative rotation therebetween.

The spring 16 may be manufactured by winding a coil spring in the conventional manner so as to have a plurality of closely adjacent or abutting turns 16A and 16B at both ends. These end turns may then be laterally compressed in a suitable hydraulic press to the desired elliptical shape.

Figure 4:
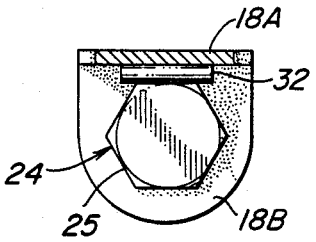
FIG. 4 is a sectional view taken along the line 4—4 of FIG. 2.

In the illustrated embodiment of the invention the stud 24 is rotated within the hole 22 in the bracket 18 to adjust the tensile force of the spring 16. After such adjustment, a locking pin 32, as best shown in FIG. 4, is inserted between the flange 18B and the adjacent flat on the head 25 of the stud 24 to prevent rotation of the stud 24 from the adjusted position. The locking pin may be square in cross-section although that particular shape is not critical.

While the present invention has been described in connection with a particular embodiment thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. A spring assembly for use with a door gate comprising:

a first mounting bracket;

a first stud having an elongated shank portion having a non-circular shaped external surface in cross-section adapted to be attached to said first mounting bracket;

a second mounting bracket;

a second stud having an elongated shank portion having a non-rotatably affixed to said second bracket; and a coil spring having a plurality of turns at one end having an interior shape and dimension which is complementary to said first stud exterior surface and being press fit onto said first stud, said spring further having a plurality of turns at a second end opposite said first end having an interior shape and dimension which is complementary to said second stud exterior surface shape, and being press fit onto said second stud.

2. The assembly as defined in claim 1 wherein said first and second stud shank portions are generally elliptical in cross section.

3. The assembly as defined in claim 2 wherein said first mounting bracket has first and second mutually perpendicular flanges, said first flange having a circular hole therethrough, and said first stud is rotatably disposed in said hole.

4. The assembly as defined in claim 3 further comprising:

means for releasably locking said first stud against rotation relative to said first mounting bracket.

5. The assembly as defined in claim 4 wherein said means for releasably locking comprises:

said first stud including a head portion having a plurality of flats thereon; and a pin insertable between one of said flats and said first brackets to prevent rotation of said first stud relative to said bracket.

* * * * *

UNITED STATES PATENT AND TRADEMARK OFFICE

CERTIFICATE OF CORRECTION

PATENT NO. : 4,731,902

DATED : March 22, 1988

INVENTOR(S) : James R. Johnston

It is certified that error appears in the above—identified patent and that said Letters Patent is hereby corrected as shown below:

Column 4, line 5, delete "having a"

Signed and Sealed this

Twenty-fifth Day of October, 1988

*Attest:*

DONALD J. QUIGG

*Attesting Officer*

*Commissioner of Patents and Trademarks*